US006809650B2

(12) United States Patent
Pfenniger et al.

(10) Patent No.: US 6,809,650 B2
(45) Date of Patent: Oct. 26, 2004

(54) METHOD AND DEVICE FOR DETERMINING THE STATE OF A RAIL STRETCH

(75) Inventors: Erich Pfenniger, Lucerne (CH); René Kunz, Lucerne (CH)

(73) Assignee: Inventio AG, Hergiswil NW (CH)

( * ) Notice: Subject to any disclaimer, the term of this patent is extended or adjusted under 35 U.S.C. 154(b) by 78 days.

(21) Appl. No.: 10/227,959

(22) Filed: Aug. 26, 2002

(65) Prior Publication Data

US 2003/0058120 A1 Mar. 27, 2003

(30) Foreign Application Priority Data

Aug. 27, 2001 (EP) ..... 01120386

(51) Int. Cl.[7] ..... G08B 21/00

(52) U.S. Cl. ..... 340/686.2; 340/686.1; 187/390; 187/391; 187/393; 187/394; 250/559.23; 250/559.26

(58) Field of Search ..... 340/686.2, 686.1, 340/541, 687, 689, 539.23, 539.13; 187/391, 394, 390, 316, 222, 393; 250/559.19, 559.23, 559.26, 559.29, 559.3, 559.31, 559.32; 200/61.18

(56) References Cited

U.S. PATENT DOCUMENTS 5,644,111 A * 7/1997 Cerny et al. ..... 187/393
5,783,784 A * 7/1998 Durand ..... 187/394
5,844,180 A * 12/1998 Liebetrau et al. ..... 187/394
5,889,239 A * 3/1999 Blackaby et al. ..... 187/391
6,050,368 A * 4/2000 Pakarinen et al. ..... 187/293
6,554,107 B2 * 4/2003 Yumura et al. ..... 187/247

FOREIGN PATENT DOCUMENTS

| | | |
|---|---|---|
| EP | 0 905 080 | 3/1999 |
| JP | 05097349 | 4/1993 |
| JP | 05193865 | 8/1993 |
| WO | WO 91/00531 | 1/1991 |

* cited by examiner

*Primary Examiner*—Davetta W. Goins
(74) *Attorney, Agent, or Firm*—MacMillan, Sobanski & Todo, LLC

(57) ABSTRACT

A method and a device for determining the state of a rail stretch utilize a receiver that is moved along the rail stretch to receive radio signals transmitted by at least three transmitters mounted in the elevator shaft. Spacing data is determined from the radio signals and is compared by an evaluating unit with reference data of the spacing to generate a result with respect to the state of the rail stretch. The positions of rail fastenings, connecting straps and shaft doors can be detected by additional sensors also moved along the rail stretch and are represented in a correction protocol to permit an efficient adjusting of the rail stretch.

20 Claims, 4 Drawing Sheets

METHOD AND DEVICE FOR DETERMINING THE STATE OF A RAIL STRETCH

BACKGROUND OF THE INVENTION

The present invention relates to a method and a device for determining the state of a rail stretch, such as a length of elevator guide rail.

Guide rails serve for the guidance of objects, for example the guidance of elevator cars. As a rule, several guide rails are connected end-to-end to form a rail stretch. Elevator cars are usually conveyed suspended by cables and guided by way of guide wheels along the rail stretch. In that case, the rectilinearity of the rail stretch becomes significant, since travel comfort depends thereon. Departures from rectilinearity of the rail stretch lead to vibrations in the elevator car. Even with a long rail stretch and fast elevator cars, for example in tall buildings, such vibrations are strongly noticeable and are perceived as disadvantageous by the passengers.

In order to determine the rectilinearity of the rail stretch in the installed state, measuring of the rail stretch is often done with a plumb bob, for example by cord or by laser. However, these measurements are very time-consuming. For this reason the measuring points are reduced in most cases to the fastening locations of the guide rails. In addition, such measurements must be undertaken at times when the elevator installation is not used, i.e. often at night, which requires night work with extra pay and makes maintenance of the elevator installation expensive. An improvement is desirable in this area.

A solution for that purpose is presented in the EP 0 905 080 European patent document. According to this method, deviations from the rectilinearity of the rail stretch are determined by way of several travel pick-ups fastened to an elongated housing. Magnitudes and position of the deviations are thereupon calculated. The travel pick-ups are mechanical or optical in nature.

A disadvantage of this solution is the high cost of this device.

SUMMARY OF THE INVENTION

The present invention concerns a method and an apparatus for determining the state of a stretch of guide rail.

An advantage of the present invention is that it provides a simple, quick and accurate method of determining the state of a rail stretch. This method and the corresponding device shall be compatible with proven techniques and standards of machine construction.

The present invention utilizes three or more transmitters and a receiver in order to determine the position of the receiver with respect to a rail stretch. For example, the transmitters are distributed in any manner in an elevator shaft of the elevator installation and locally fixed. Advantageously, the transmitters are arranged in the elevator shaft at the greatest possible angular spacings from the receiver for a triangulation. The receiver is advantageously moved at a constant spacing with respect to a guide surface of the rail stretch. The surface along which the elevator car is conveyed on the rail stretch is termed a guide surface. The receiver is placed on, for example, the guide surface of the installed rail stretch. The transmitters transmit radio signals to the receiver similarly to a GPS (Global Positioning System).

In advantageous forms of embodiment additional sensors detect freely selectable locations such as rail fastenings, rail straps, floor stopping points or positions of the shaft doors, as soon as the receiver passes the level thereof in the elevator shaft. Advantageously, an acceleration sensor for detection of acceleration forces in the elevator car is provided. This further detection advantageously takes place simultaneously with the determination of the position of the guide surface.

In the measuring operation the receiver detects, preferably continuously and while it is moved along the guide surface of the rail stretch over the entire length of the rail stretch, the spacings from the individual transmitters or in each instance the position of rail fastenings, rail straps and shaft doors with respect to the displacement path of the receiver. The receiver preferably ascertains spacing data, i.e. the instantaneous spacing from the transmitters, on the basis of the detected radio signals. These spacing data are ascertained, for example, incrementally per unit of length and unit of time.

The resulting spacing data are preferably passed on to the evaluating unit. The evaluating unit compares the spacing data with reference data of the spacing of the receiver from the transmitters. Such reference data are, for example, ascertained in a calibration process and stored. This comparison delivers, as the result, departures from the rectilinearity of the rail stretch. This result can be represented, for example, graphically as a curvature in three dimensions. An advantageous result of the evaluation is a correction protocol, in accordance with which the engineers can straighten the individual guide rails of the rail stretch. Equipped with precise diagrams, as also straightening proposals, the engineer can precisely realign the rail stretch and this rapidly achieves or maintains an optimum travel behavior of the elevator car.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
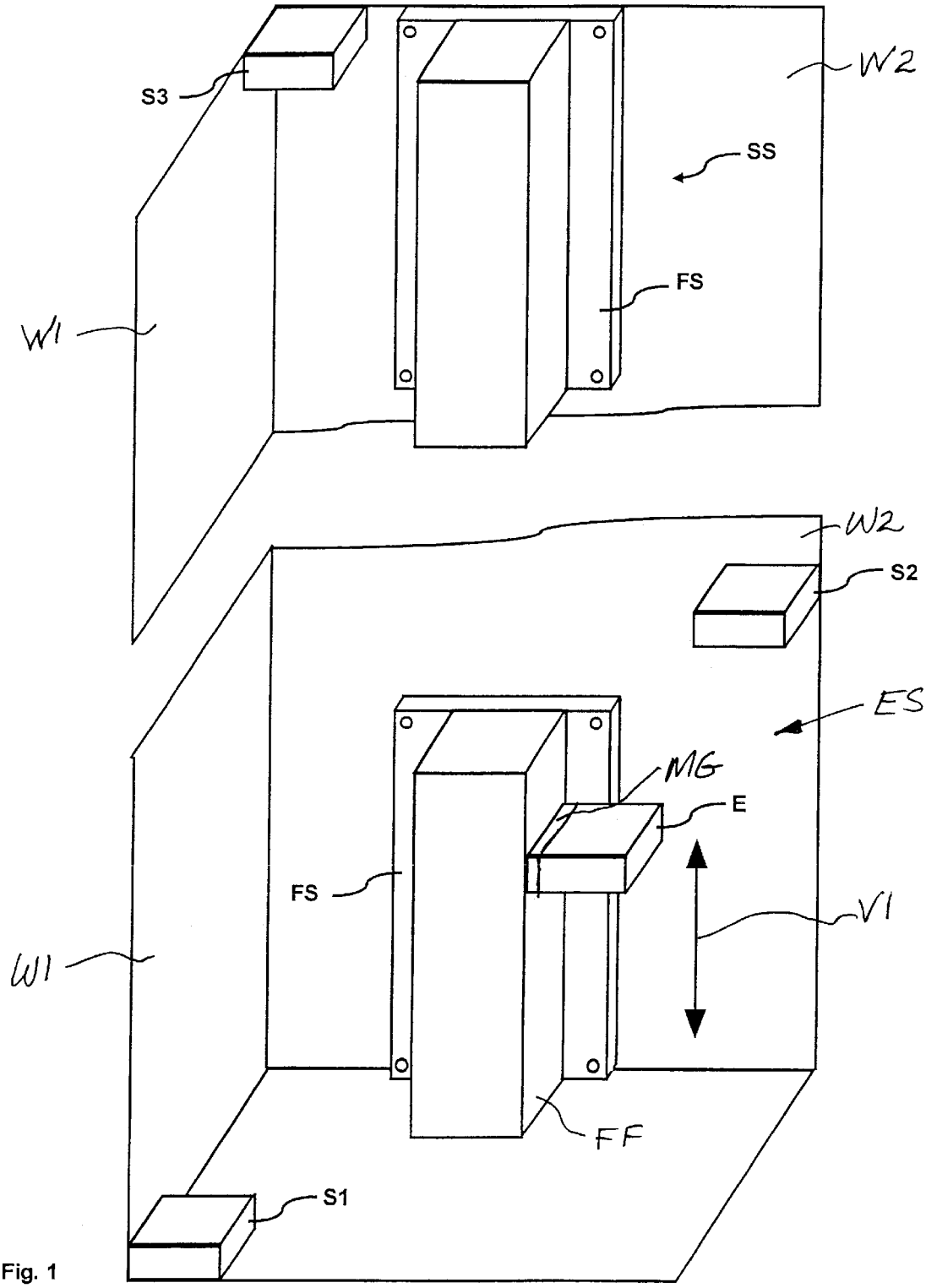
FIG. 1 is a schematic perspective illustration of a first embodiment of the present invention showing a part of an elevator installation with three transmitters and a receiver.

FIG. 1 shows schematically a first exemplary embodiment of a device for determining the state of a rail stretch SS in an elevator shaft ES with at least three transmitters S1, S2 and S3 and a receiver E. The receiver E is movable with respect to the rail stretch SS, which is illustrated by an elongated double arrow V1. The transmitters S1, S2 and S3 are distributed anywhere in the elevator shaft ES and locally fixed in order to increase measuring accuracy. The transmitters are preferably to be mounted so that a greatest possible angle relative to the receiver E is achieved.

The straightening of the rail stretch SS in the elevator shaft ES is advantageously carried out in five method steps.

1. Provisionally assemble guide rails to form a rail stretch.
2. Position transmitters in the shaft and receiver at the rail stretch.
3. Measure the rectilinearity of the rail stretch or pick-up of spacing data.
4. Evaluate the spacing data.
5. Straighten the rail stretch on the basis of the correction protocol.

Figure 2:
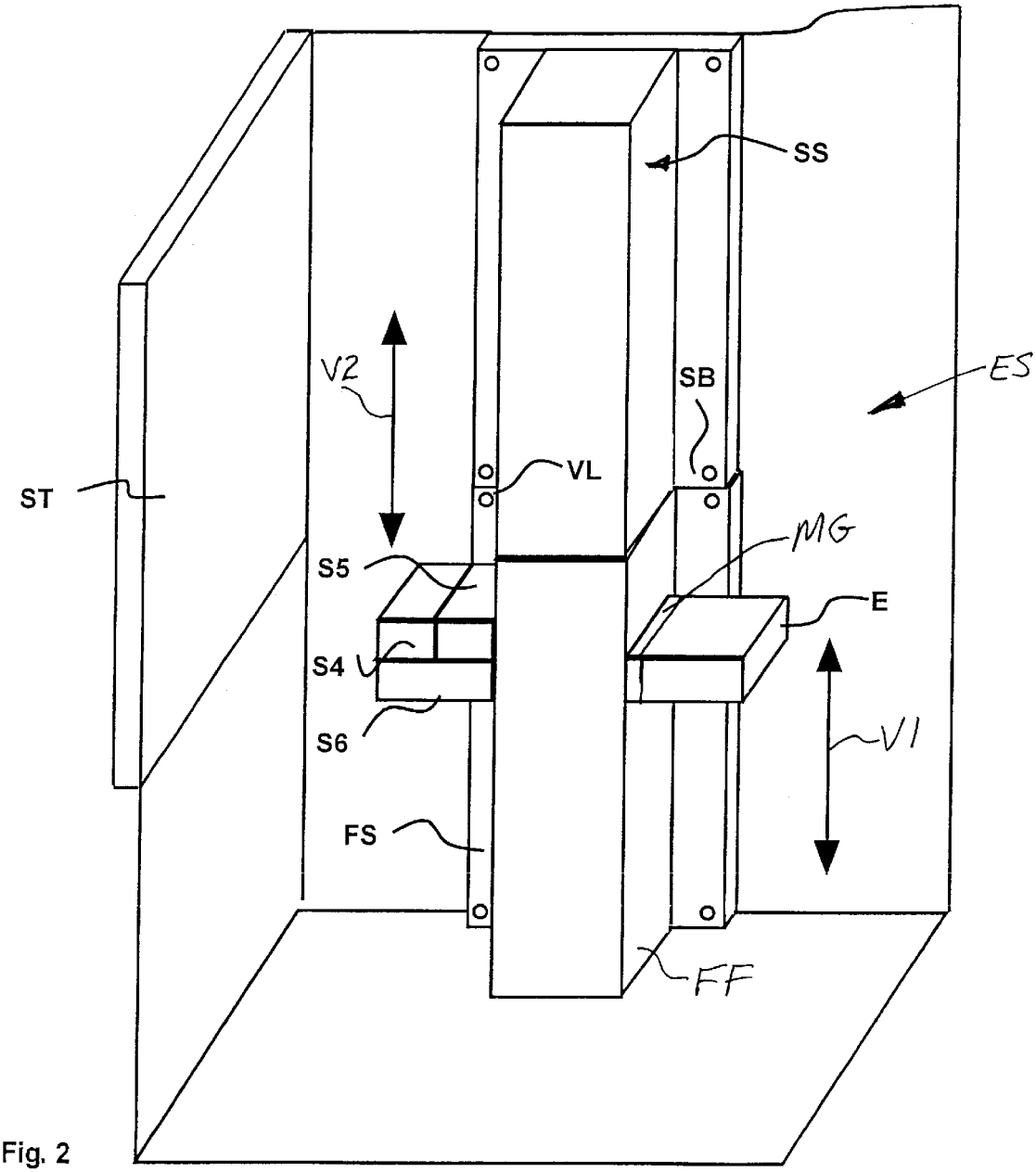
FIG. 2 is a schematic perspective illustration of a second embodiment of the present invention showing a part of an elevator installation with sensors at the rail fastenings, the rail straps and the shaft doors.

With regard to the individual method steps:

In a first method step, guide rails FS are mounted one after the other over the entire vertical travel path of the elevator car in the elevator shaft ES. The guide rails FS are, for example, T-beams of steel with known standard constructional dimensions. The length of the guide rails FS is known and amounts to, for example, 5 meters. Height and width of the guide rail amount to, for example, 88 mm and 16 mm respectively. According to FIGS. 1 and 2, the individual guide rails FS are connected together by way of connecting straps VL to form the rail stretch SS. In a first assembly, the rail stretch SS is, for example, fastened by means of rail fastenings SB by way of, for example, screws to a shaft wall and provisionally aligned.

In a second method step, the transmitters S1, S2 and S3 are mounted in the elevator shaft ES. Any transmitters which transmit radio signals can be used. According to FIG. 1, a portion of the elevator shaft ES is shown including a wall W1 forming a corner with a wall W2 to which the rail stretch SS is attached. The first transmitter S1 is fixed in a front region of the wall W1 at a base of the elevator shaft ES, the second transmitter S2 is fixed centrally in a region on wall W2 of the elevator shaft to the right of the rail stretch SS and the third transmitter S3 is fixed in the corner of the walls W1 and W2 to a ceiling (not shown) of the elevator shaft. The transmitters S1, S2 and S3 are advantageously mounted at the greatest possible angular spacing relative to one another and in the case of large travel heights or shaft heights, advantageously several groups of the transmitters S1, S2 and S3 can be mounted. For example, several groups of three transmitters are arranged in series one after the other over the entire shaft height. In an elevator shaft with a large travel height, the arrangement of several of the groups of transmitters can be such that the individual transmitters of each such group adopt a large angular spacing relative to one another and thus an exact triangulation within the transmission range of the respective group of transmitters is ensured. The transition from one transmitter group to the adjoining transmitter group can be flagged by, for example, a travel height signal picked up by the receiver E. For example, the travel height signal is mechanically picked up by the receiver E or transmitted by the transmitters S1, S2 and S3 to the receiver E. The first and second method steps relating to the mounting of the device for determining the state of a rail stretch can be undertaken, for example, in any sequence or simultaneously.

In the third method step, for measuring the rectilinearity of the rail stretch SS the receiver E is moved along the rail-stretch SS by hand, by accompanying travel on a roof of the elevator car and/or, however, by lowering the receiver E by a cable or pulling it up. For preference, and in order to avoid externally caused measurement inaccuracies, the receiver E is moved in controlled and reproducible manner and, for example, moved by way of a guide MG, such as a roller or slide guide, along a guide surface FF, while, for example, at least one magnet of the guide MG keeps the receiver E in constant contact with the rail stretch SS or at a constant spacing from the rail stretch SS.

In measuring operation the receiver E detects, preferably continuously, the spacings from the individual transmitters S1, S2 and S3. The receiver E determines, on the basis of the detected radio signals, spacing data AD, i.e. the instantaneous spacing from the transmitters S1, S2 and S3. These spacing data AD are advantageously ascertained incrementally per unit of length and unit of time for each of the receivers.

Optionally, sensors S4, S5 and S6 can be provided which, additionally to the receiver E, detect important features of the rail stretch SS. In the second exemplary embodiment of a device for determining the state of the rail stretch SS, as shown in the FIG. 2, there are detected by way of the sensors S4, S5 and S6, respectively, the positions of the rail fastenings SB, the positions of the screws of the connecting straps VL and the positions of shaft doors ST. Advantageously, such detections are carried out by the sensors S4, S5 and S6 as they are guided along the rail stretch SS (arrow V2) simultaneously with the receiver E and the positions of the rail fastenings SB or the connecting straps VL or the shaft doors ST in the elevator shaft are localized. Through detection of the position of the rail fastenings SB, the screws of connecting straps VL and the shaft doors ST during passage of the receiver E, the spacing data AD of the receiver E relative to the transmitters S1, S2 and S3 can be processed together with additional spacing data ZAD. The additional sensors S4, S5 and S6 generate the additional spacing data ZAD. The first sensor S4 determines the position of the rail fastenings SB from the rail stretch SS, the second sensor S5 determines the position of the connecting strap VL or the screws thereof in the rail stretch SS and the third sensor S6 determines the spacing and the position of shaft doors ST relative to the rail stretch SS. These additional spacings data ZAD are preferably determined incrementally per unit of length and unit of time. The sensors S4, S5 and S6 can be, for example, commercially available distance measuring devices of mechanical, electronic and/or optical kind.

Figure 3:
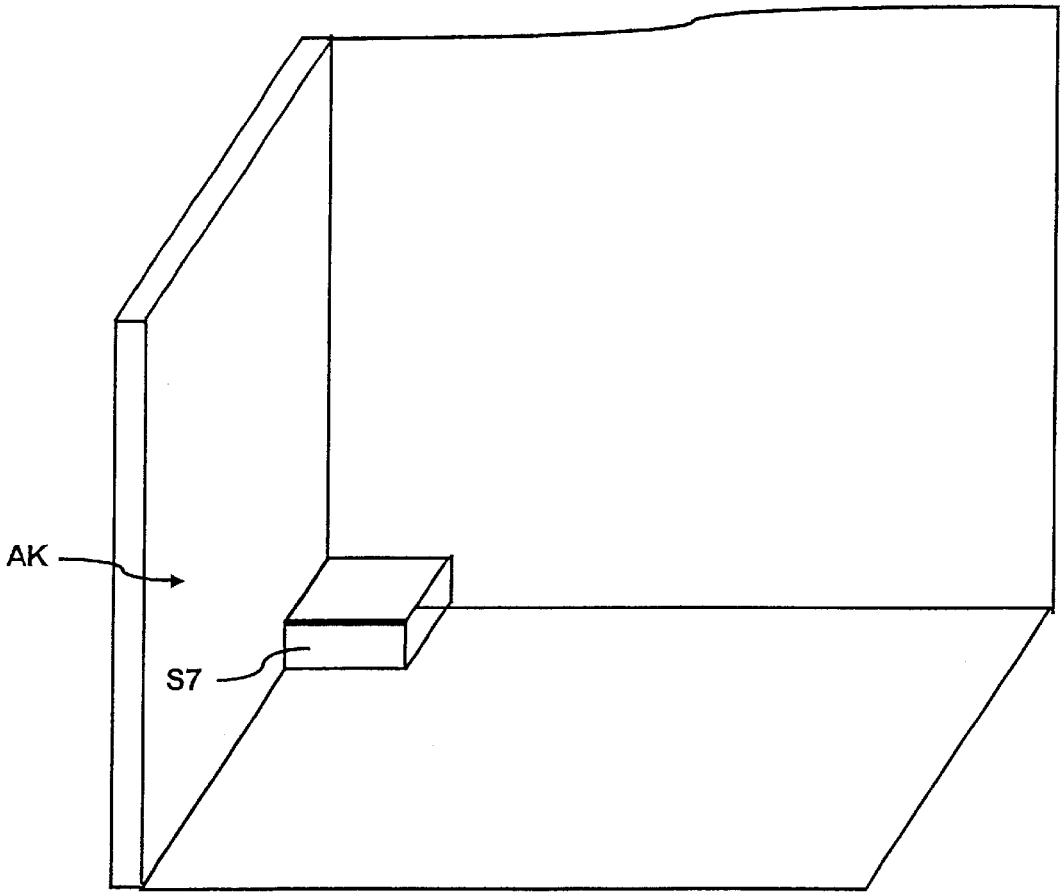
FIG. 3 is a schematic perspective illustration of a third embodiment of the present invention showing part of an elevator installation with an acceleration sensor in the elevator car.

It is optionally possible, during the ascertaining of the spacing data AD, to also determine preferably simultaneously the transverse acceleration in an elevator car AK by way of at least one acceleration sensor S7. In the third exemplary embodiment of a device for determining the state of the rail stretch SS according to FIG. 3, an acceleration data signal BD representing the actual transverse accelerations transferred to the elevator car AK is thus generated. These acceleration data BD are preferably determined incrementally per unit of length and unit of time. The acceleration sensor S7 determines the acceleration data BD in dependence on travel and thus has an influence in substantially two forms on the evaluation of the rectilinearity of the rail stretch SS.

On the basis of the acceleration data BD, regions of the rail stretch SS can be identified in which the guide rail FS is mounted imprecisely in an impermissible manner. The acceleration data BD then serves as a localization aid for impermissible deviations. The engineer must then straighten the rail stretch SS only in such localized "conspicuous regions", which markedly reduces the assembly times or correction times.

It is possible through the spacing data AD of the rail stretch SS on the one hand and through the acceleration data BD, on the other hand to determine a transfer behavior, which is characteristic for the elevator installation, in dependence on the travel. The transfer behavior can then be used for, for example, an active cancellation out of the rail inaccuracies, i.e. "active ride". Since the "critical regions" are known in the above-described manner in the form of the correction protocol, the respective location can be quickly and rapidly rediscovered with the help of the equipment for measuring the rectilinearly of the rail stretch SS, particularly with the help of the receiver E. For that purpose the engineer moves the receiver E along the rail stretch SS again and in that case tracks, for example, in real time the result of the triangulation, from which he can read off the instantaneous position of the receiver. In this manner he removes the receiver E until at the "critical location", which he can then straighten in correspondence with the correction protocol.

Figure 4:
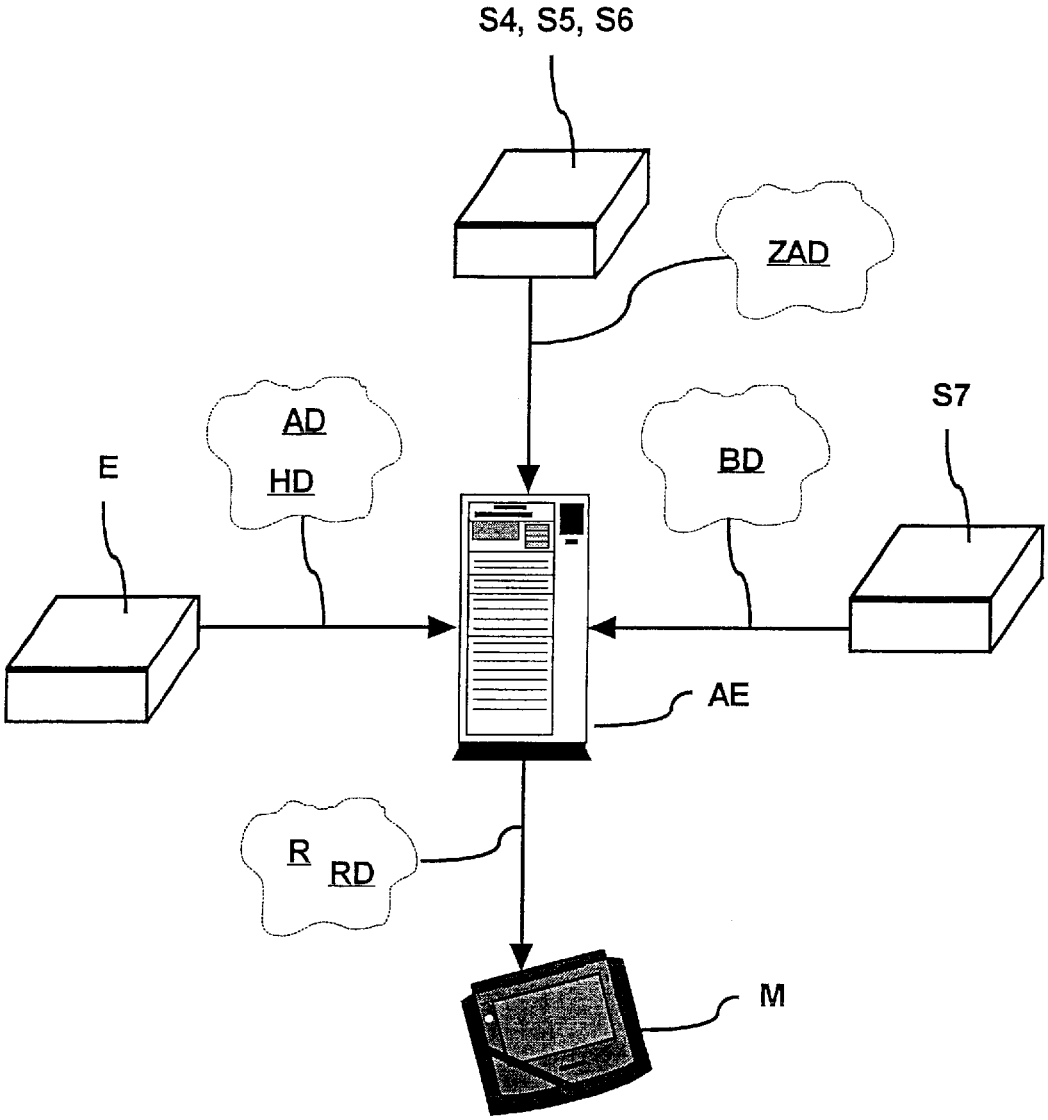
FIG. 4 is a schematic block diagram of the detection, transmission and evaluation of spacing data or elevator travel data or additional spacing data or acceleration data according to the present invention.

FIG. 4 shows a schematic block diagram of the detection, transmission and evaluation of the spacing data AD, the additional spacing data ZAD, travel height data HD and the acceleration data BD. The spacing data AD and the travel height data HD are ascertained by the receiver E and transferred to an evaluating unit AE. The additional spacing data ZAD ascertained by the sensors S4, S5 and S6 are transferred to the evaluating unit AE. The acceleration data BD ascertained by the acceleration sensor S7 is transferred to the evaluating unit AE. The spacing data AD, the additional spacing data ZAD, the travel height data HD and the acceleration data BD are communicated as signals, preferably as digital signals, by way of, for example an electrical signal line or wirelessly by radio to the evaluating unit AE. The evaluating unit AE is advantageously a commercially available computer with a central computing unit and at least one memory, communications interfaces, etc.

In a fourth method step in advantageous manner initially a lowermost point of a reference curve R and an uppermost point of the reference curve R are computed starting out from previously ascertained values of the spacing data AD, the additional spacing data ZAD, the travel height data HD and the acceleration data BD, which correspond with an actual course of the guide surface FF of the rail stretch SS. Between this lowermost point and the uppermost point of the reference curve R, the entire reference curve together with reference data RD is, with advantage, computed with the help of analytical methods. This reference curve R represents the desired course of the guide surface FF of the rail stretch SS provided under respectively different optimized viewpoints. Three kinds of reference curves R can, by way of example, be computed as follows:

a) a straight line which is laid by interpolation through the lowermost point and the uppermost point of the reference curve R.

b) an interpolation which is adapted to the previously measured positions of the rail fastenings SB and/or the connecting straps VL and/or the shaft doors ST.

c) the reference curve R dependent on the transverse accelerations.

In the determination of the reference curves R of the first to third kinds a) to c), the optionally detected travel height data HD serves for distinguishing individual transmitter groups, so that with advantage only one evaluating unit AE is needed for evaluating the spacing data AD.

In the case of determination of reference curves R of the second kind b), the interpolation extends to the regions between the individual rail fastenings SB, the connecting straps VL and the shaft doors ST. The optionally detected additional spacing data ZAD thus serves for preparation of the spacing data AD and the correction data in the evaluating unit AE. The spacing of the shaft door ST is of significance in the case of a correction of the rail stretch insofar as the spacing is defined in this region and need not be arbitrarily adjusted.

Corrections can be undertaken with the connecting straps VL and with the rail fastenings SB, but the spacing from the shaft doors ST need not be shifted out of the tolerance range.

In the case of determining reference curves R of the third kind c), the slope of the reference curve R, for example, is computed. A horizontal transverse acceleration, which is induced at the elevator car AK by the rail stretch SS, is computed from the slope of the reference curve R. In that case it is proposed to predetermine a maximum permissible acceleration range or a freely settable permissible acceleration interval and to so compute the course of the reference curve R that this moves within this acceleration interval. As soon as the reference data RD of the reference curve R exceeds the acceleration range, the rail stretch SS is straightened. It is thus achieved that on the one hand the rail stretch SS has to be straightened only as accurately as necessary and more expensive assembly time can be saved and on the other hand no vibrations prejudicing travel comfort are transferred from the rail stretch SS to the elevator car AK. The reference curve R as well as the reference data RD can be stored and can be called up. It is possible to store the reference data RD in a central data bank, for example in an archive and to deliver it to the engineer, for example on interrogation as signals, preferably as digital signals, for example by way of an electrical signal line or wirelessly by radio. It is obviously also possible to store the reference data RD decentrally in the evaluating unit AE. With knowledge of the present invention, the expert has numerous possibilities of variation in storage and making available reference curves or reference data.

On the basis of the reference curve R and the reference data RD there can be computed, for each position of the rail stretch SS, the relative deviation of the actual course of the guide surface FF of the rail stretch SS with respect to the reference curve R. The obtained relative deviations are made available to the engineer who thereby obtains positionally dependent information about the direction in which and the amount by which the provisionally mounted guide rail FS must be straightened so that it corresponds with the selected reference curve R together with reference data RD.

In a fifth method step, localized non-rectilinearities of the rail stretch SS are straightened by the engineer according to, for example, a correction protocol on the basis of the reference curve R with the reference data RD. The reference data enables precise diagrams as well as concrete straightening proposals, so that the engineer can accurately and quickly straighten the rail stretch SS. It is also possible to display the correction or the result of the correction "on line", i.e. in real time, for example on a monitor M. In the embodiment according to FIG. 4, the monitor M is part of a portable computer, for example a hand-held computer, which obtains reference data by way of, for example, a signal cable or wirelessly by radio. In principle it is possible to realize the evaluating unit AE and the monitor M in a portable computer, for example in a hand-held computer. Overall, the quality of the straightening operation is thereby significantly increased.

By contrast to previously known methods and devices for measuring rail inaccuracies, the method proposed here offers the following advantages:

The rail stretch SS is detected with the help of transmitters, which are arranged in stationary locations, in the elevator shaft ES. This takes place in incremental steps and delivers absolute positions of the rail stretch. Non-rectilinearities of the rail stretch can thus be localized very precisely.

By comparison with previously known laser adjusting devices, the alignment of the laser beam is redundant and no errors, which are caused by optical effects or by detection, inadequate beam focusing or obstacles in the elevator shaft, occur.

Determining/ascertaining the transfer behavior between rail stretch and elevator car in the case of embodiments with acceleration measurement in the elevator car.

Straightening of the rail stretch is possible without the elevator car, for example by lowering or pulling up the receiver along the rail stretch.

Continuous detection of the non-rectilinearity of the rail stretch.

Sensors detect the rail fastenings and rail straps. Thus, disturbance locations and, at the same time, locations where the rail stretch can be corrected are localized very precisely.

Precise straightening of the rail stretch thanks to concrete statements in millimeters about where and how much correction must be made.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of determining a state of a stretch of guide rail in an elevator shaft comprising the steps of:

a. providing at least three signal transmitters fixed in an elevator shaft spaced from each other and relative to a stretch of elevator guide rail;

b. moving a receiver along a guide surface of the stretch of guide rail to receive a signal from each of the transmitters at a selected position along the stretch;

c. processing the signals to determine a spacing data representing a spacing of the receiver from each of the transmitters at the selected position along the stretch of guide rail;

d. comparing the spacing data with reference data representing a desired spacing at the selected position along the stretch of guide rail to generate difference data; and e. generating a result with respect to a state of rectilinearity of the stretch of guide rail from the difference data.

2. The method according to claim 1 wherein said step a. is performed by positioning the transmitters in at least two groups of three transmitters each spaced along the stretch of guide rail.

3. The method according to claim 1 wherein said step a. is performed by positioning the transmitters spaced along the stretch of guide rail at a relatively great angular spacing relative to one another.

4. The method according to claim 1 wherein said step a. is performed by positioning the transmitters in at least two groups spaced along the stretch of guide rail, said step b. includes generating a travel height signal representing a position of the receiver along the stretch of guide rail, and said step c. includes processing the travel height signal to determine the spacing data.

5. The method according to claim 1 wherein said step b. is performed by mounting the receiver on a guide and moving the guide along a guide surface of the stretch of guide rail.

6. The method according to claim 5 including providing one of a roller guide and a slide guide engaging the guide surface as the guide.

7. The method according to claim 5 wherein said step b. is performed by providing at least one magnet on the guide to hold the receiver at a constant spacing from the guide surface.

8. The method according to claim 1 including a step of moving a rail fastening sensor along the stretch of guide rail, generating a detection signal representing a detection of rail fastenings mounting the stretch of guide rail in the elevator shaft, and processing the detection signal in said step c.

9. The method according to claim 1 including a step of moving a connecting strap sensor along the stretch of guide rail, generating a detection signal representing a detection of guide rail connecting straps along the stretch of guide rail in the elevator shaft, and processing the detection signal in said step c.

10. The method according to claim 1 including a step of moving a shaft door sensor along the stretch of guide rail, generating a detection signal representing a detection of shaft doors along the stretch of guide rail in the elevator shaft, and processing the detection signal in said step c.

11. The method according to claim 1 including a step of providing an acceleration sensor on an elevator car for generating acceleration data representing a transverse acceleration of the elevator car as the elevator car moves along the stretch of guide rail and performing said step e. utilizing the acceleration data.

12. The method according to claim 1 wherein said step c. is performed by determining the spacing data per unit of length along the rail stretch and per unit of time.

13. The method according to claim 1 wherein said step e. is performed by generating the result as a reference curve.

14. The method according to claim 13 wherein a lowermost point of the reference curve and an uppermost point of the reference curve are calculated from the spacing data.

15. A device for determining a state of a rail stretch of a elevator comprising:

at least three transmitters transmitting signals and adapted to be mounted at spaced apart locations along an elevator rail stretch in an elevator shaft;

a receiver movable along a guide surface of the rail stretch and responsive to said signals for generating spacing data representing a spacing of said receiver from each of said transmitters at a selected position along the stretch; and an evaluating unit for comparing said spacing data received from said receiver with reference data representing a desired spacing of said receiver from each of said transmitters and for generating a result with respect to a state of rectilinearity of the rail stretch.

16. The device according to claim 15 including a rail fastening sensor movable along the stretch of guide rail for generating to said evaluating unit a detection signal representing a detection of rail fastenings mounting the stretch of guide rail in the shaft.

17. The device according to claim 15 including a connecting strap sensor movable along the stretch of guide rail for generating to said evaluating unit a detection signal representing a detection of guide rail connecting straps along the stretch of guide rail in the elevator shaft.

18. The device according to claim 15 including a shaft door sensor movable along the stretch of guide rail for generating to said evaluating unit a detection signal representing a detection of shaft doors along the stretch of guide rail in the elevator shaft.

19. The device according to claim 15 including an acceleration sensor adapted to be mounted on an elevator car for generating acceleration data to said evaluating unit representing a transverse acceleration of the elevator car as the elevator car moves along the stretch of guide rail.

20. A method of determining a state of a stretch of guide rail in an elevator shaft comprising the steps of:

a. providing at least three signal transmitters in an elevator shaft spaced from and fixed relative to a stretch of elevator guide rail;

b. moving a receiver along a guide surface of the stretch of guide rail to receive a signal from each of the transmitters;

c. processing the signals to determine spacing data representing a spacing of the receiver from each of the transmitters along the stretch of guide rail;

d. comparing the spacing data with reference data representing a desired spacing along the stretch of guide rail to generate difference data;

e. generating a result with respect to a state of the stretch of guide rail from the difference data;

f. providing an acceleration sensor on an elevator car for generating acceleration data representing a transverse acceleration of the elevator car as the elevator car moves along the stretch of guide rail and performing said step e. utilizing the acceleration data; and g. predetermining a maximum permissible acceleration range and straightening the stretch of guide rail as soon as the acceleration range is exceeded by the acceleration data.

* * * * *